US010421177B2

(12) United States Patent
Takahashi et al.

(10) Patent No.: US 10,421,177 B2
(45) Date of Patent: Sep. 24, 2019

(54) EXTRACTION DEVICE AND RETAINING DEVICE

(71) Applicant: Kabushiki Kaisha Toshiba, Minato-ku, Tokyo (JP)

(72) Inventors: Ryoichi Takahashi, Yokosuka Kanagawa (JP); Kazuhiko Noda, Hino Tokyo (JP); Kie Kubo, Toshima Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 175 days.

(21) Appl. No.: 14/914,951

(22) PCT Filed: Mar. 12, 2014

(86) PCT No.: PCT/JP2014/056476
§ 371 (c)(1),
(2) Date: Feb. 26, 2016

(87) PCT Pub. No.: WO2015/029477
PCT Pub. Date: Mar. 5, 2015

(65) Prior Publication Data

US 2016/0221167 A1 Aug. 4, 2016

(30) Foreign Application Priority Data

Aug. 27, 2013 (JP) ..... 2013-175984

(51) Int. Cl.
*B25B 27/06* (2006.01)

(52) U.S. Cl.
CPC ..... *B25B 27/06* (2013.01)

(58) Field of Classification Search
CPC ..... B25B 27/06
See application file for complete search history.

(56) References Cited

U.S. PATENT DOCUMENTS 2,678,217 A 5/1954 King
2015/0239737 A1 8/2015 Takahashi et al.

FOREIGN PATENT DOCUMENTS

JP 40-032638 Y1 11/1965
JP 04-049165 U 4/1992

(Continued)

OTHER PUBLICATIONS

Office Action dated Apr. 18, 2014 in corresponding JP Application No. 2013-175984, 3 pgs.

(Continued)

*Primary Examiner* — David P Bryant
*Assistant Examiner* — Nirvana Deonauth
(74) *Attorney, Agent, or Firm* — Knobbe, Martens, Olson & Bear, LLP

(57) ABSTRACT

According to an embodiment, an extraction device includes an elastic body, first and second pressing units, and a pulling unit. The elastic body includes a first end facing a first direction, a second end, and a contact face facing a second direction intersecting with the first direction. The elastic body can expand in the second direction. The first and second pressing units press the first and second end. The pulling unit pulls the second pressing unit toward the first direction. The contact face comes into contact with an object when the elastic body compressed by pressing forces of the first pressing unit and the second pressing unit expands in the second direction. The pulling unit pulls the object with friction between the object and the contact face when the pulling unit is pulled in the first direction while the contact face of the elastic body is in contact with the object.

12 Claims, 9 Drawing Sheets

(56) References Cited

FOREIGN PATENT DOCUMENTS

| | | | |
|---|---|---|---|
| JP | 05-278110 | A | 10/1993 |
| JP | 09-103819 | A | 4/1997 |
| JP | 2011-080252 | A | 4/2011 |
| WO | WO 2014/024510 | A1 | 2/2014 |

OTHER PUBLICATIONS

International Search Report dated Apr. 28, 2014 in corresponding PCT Application No. PCT/JP2014/056476, 6 pgs.

EXTRACTION DEVICE AND RETAINING DEVICE

CROSS-REFERENCE TO RELATED APPLICATIONS

This application is national stage application of International Application No. PCT/JP2014/056476, filed Mar. 12, 2014, which designates the United States, incorporated herein by reference, and which claims the benefit of priority from Japanese Patent Application No. 2013-175984, filed Aug. 27, 2013, the entire contents of which are incorporated herein by reference.

FIELD

Embodiments described herein relate generally to an extraction device and a retaining device.

BACKGROUND

For example, a member such as a tube and a bar driven into the ground or inserted into a device is extracted as necessary. The member, for example, is extracted by hand, by a lever or a chucking apparatus, or pushed out from the opposite side.

DETAILED DESCRIPTION

According to an embodiment, an extraction device includes an elastic body, a first pressing unit, a second pressing unit, and a pulling unit. The elastic body includes a first end facing a first direction, a second end positioned opposite from the first end, and a contact face facing a second direction intersecting with the first direction, the elastic body configured to expanding in the second direction. The first pressing unit is configured to press the first end of the elastic body. The second pressing unit is configured to press the second end of the elastic body. The pulling unit is configured to pull the second pressing unit toward the first direction. The contact face is configured to come into contact with an object to be extracted when the elastic body compressed by pressing force of the first pressing unit and pressing force of the second pressing unit expands in the second direction. The pulling unit is configured to pull the object to be extracted with friction between the object to be extracted and the contact face when the pulling unit is pulled in the first direction while the contact face of the elastic body is in contact with the object to be extracted.

Hereinafter, a first embodiment will be described with reference to FIG. 1 to FIG. 9. It is noted that different representations may be used for the components according to the embodiments and the descriptions thereof. This does not prevent different representations not described herein to be used for the components and the descriptions. Furthermore, this does not prevent different representations to be used for the components and the descriptions with which different representations are not described.

Figure 1:
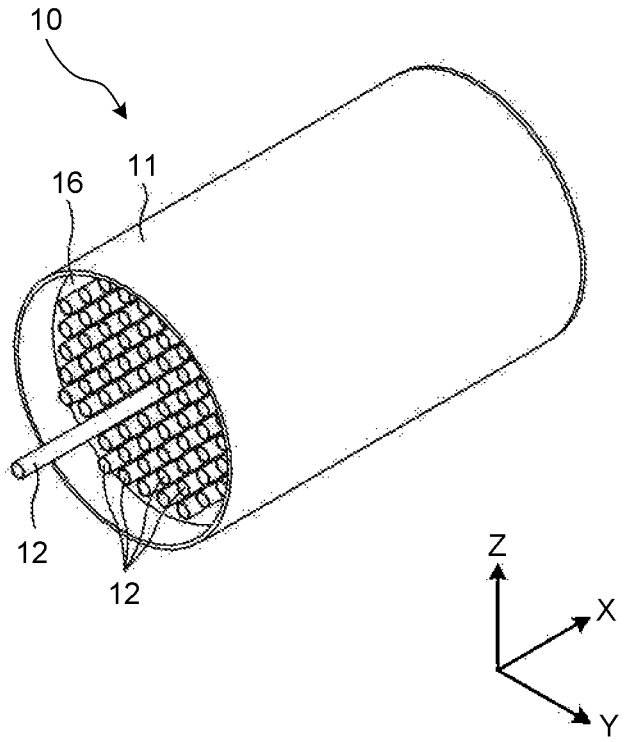
FIG. 1 is a perspective view of an ozone generation device according to a first embodiment.
Figure 2:
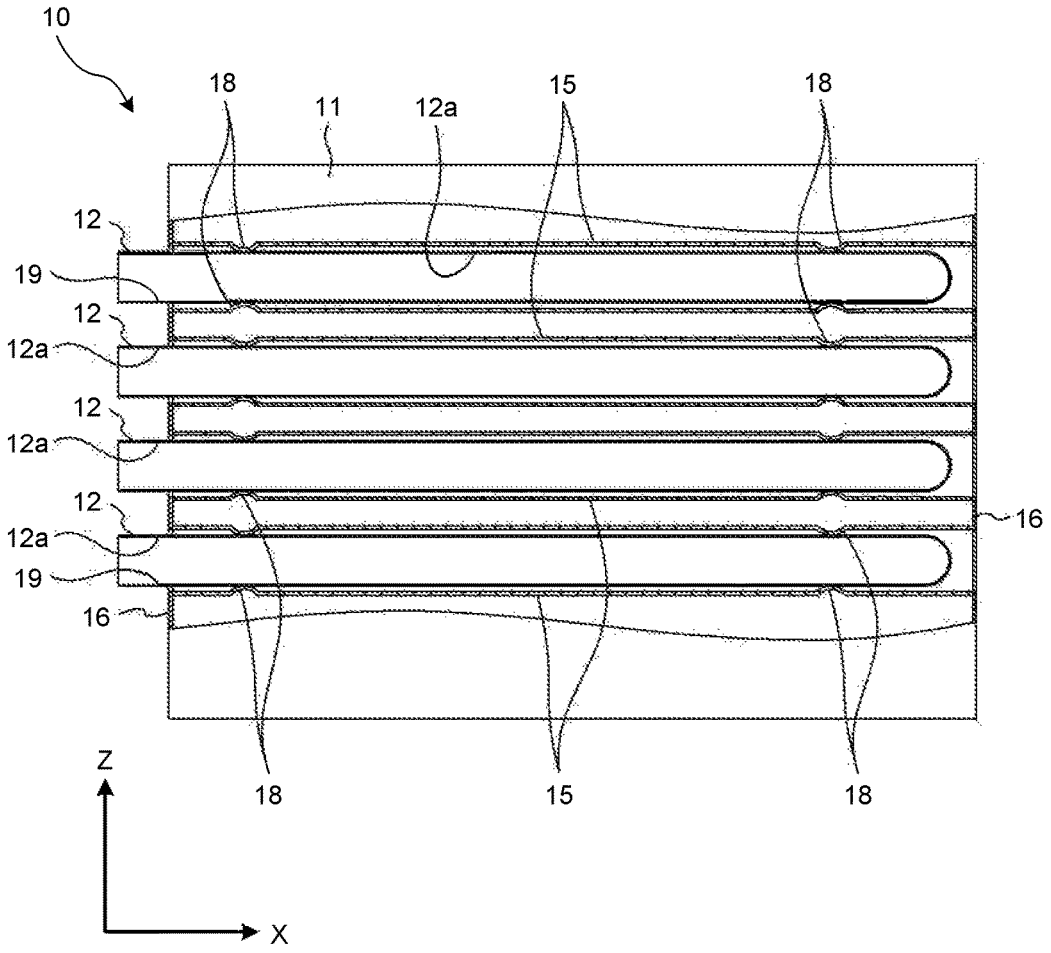
FIG. 2 is a sectional view of the ozone generation device of the first embodiment.

FIG. 1 is a perspective view schematically illustrating an ozone generation device 10. FIG. 2 is a sectional view schematically illustrating the ozone generation device 10. As illustrated in FIG. 1 and FIG. 2, the ozone generation device 10 includes a can body 11 and a plurality of discharge tubes 12. Each of the discharge tubes 12 is an example of an object to be extracted and an object, and for example, may also be referred to as a subject, a tube, a member, or an insertion.

The can body 11 is formed in a substantially columnar shape in which a plurality of holes are provided. As illustrated in FIG. 2, the can body 11 includes a plurality of tube units 15 and a pair of end plates 16. The tube units 15 extend in the longitudinal direction of the can body 11, and are arranged in parallel to each other. Each of the end plates 16 forms an end face of the can body 11 in the longitudinal direction. A plurality of holes are provided in the end plates 16. The tube units 15 are arranged corresponding to the multiple holes in the end plates 16. In other words, the holes provided in one of the end plates 16 and the holes provided in the other end plate 16, are connected by the corresponding tube units 15.

A plurality of spacers 18 are provided on the tube unit 15. Each of the spacers 18 projects from the inner peripheral face of the tube unit 15. The spacer 18 is integrally formed with the tube unit 15. However, the spacer 18 is not limited thereto, and may be a separate part from the tube unit 15.

The discharge tube 12 is inserted into the inside of the tube unit 15. The spacers 18 support the discharge tube 12. The spacers 18 retain the discharge tube 12 by coming into contact with the discharge tube 12 from a plurality of directions. The discharge tube 12 retained by the spacers 18 extends along the tube unit 15.

The discharge tube 12 is a glass tube the inner face of which is coated with a metal film. One end of the discharge tube 12 is open. A dome-shaped bottom closes the other end of the discharge tube 12. In other words, the discharge tube 12 is a tube having a bottom. More specifically, the discharge tube 12 has an opening 19 that opens to one end. The opening 19 is an example of a third opening. The thickness of the discharge tube 12, for example, is about 1 [mm].

The ozone generation device 10 also includes a pair of lids, an alternating current (AC) power supply, an air supply device, a cooling water supply device, and a cooling system. The pair of lids covers the pair of end plates 16. The cooling water supply device and the cooling system allow coolant to flow inside the can body 11, thus cooling the ozone generation device 10.

As illustrated in the diagrams, an X-axis, a Y-axis, and a Z-axis are defined in the present specification. The X-axis, the Y-axis, and the Z-axis are orthogonal to each other. The X-axis is along the longitudinal direction of the discharge tube 12. In other words, the discharge tube 12 and the opening 19 extend along the X-axis.

Figure 3:
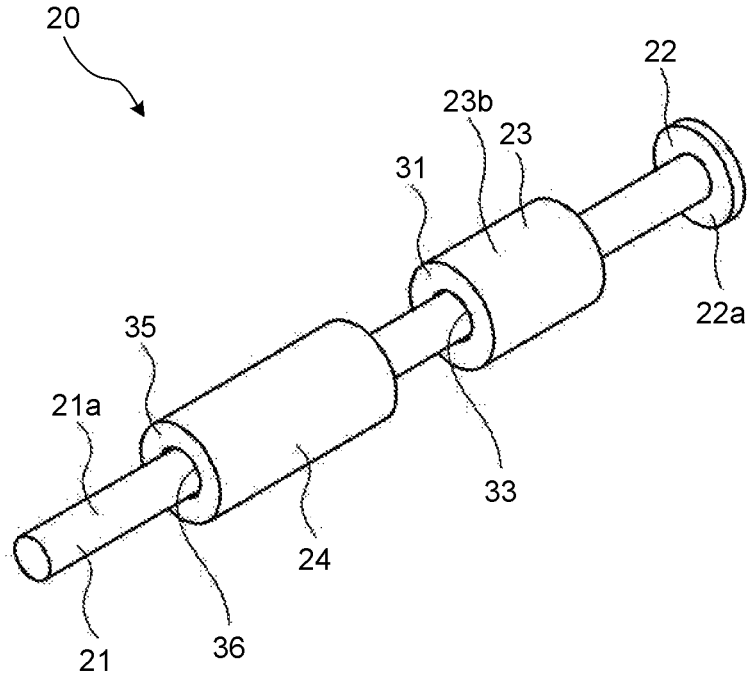
FIG. 3 is a perspective view of an extraction device of the first embodiment.

FIG. 3 is a perspective view of an extraction device 20. The inside of the tube unit 15 is cleaned during the maintenance and inspection of the ozone generation device 10. At such a time, for example, the discharge tube 12 is extracted from the ozone generation device 10. The extraction device 20 is used for the extraction operation of the discharge tube 12.

The extraction device 20 includes a bar 21, a flange unit 22, an elastic body 23, and a tube body 24. The bar 21 is an example of a pulling unit, and for example, may also be referred to as a shaft, a retaining unit, a gripping unit, or an operating unit. The flange unit 22 is an example of a second pressing unit and a first member, and for example, may also be referred to as an abutting unit, a receiving unit, a compressing unit, or a supporting unit. The elastic body 23 is an example of a third member, and for example, may also be referred to as a deforming unit, an inflation unit, a contacting unit, a friction unit, or an expansion unit. The tube body 24 is an example of a first pressing unit and a second member, and for example, may also be referred to as a compression unit, a pressure-applying unit, a supporting unit, a moving unit, or a sliding unit.

Figure 4:
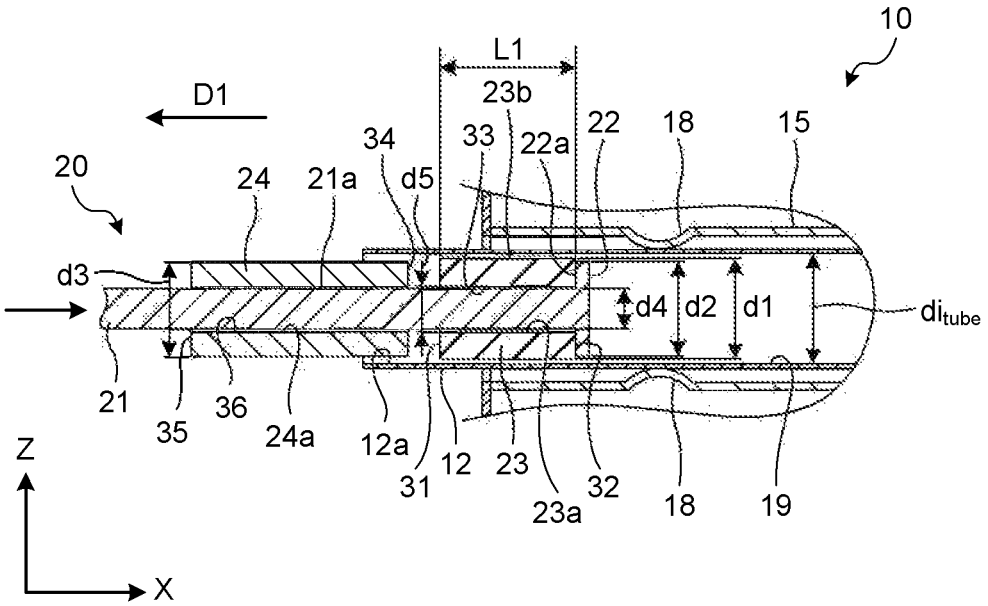
FIG. 4 is a sectional view of the extraction device of the first embodiment that is inserted into a discharge tube.

FIG. 4 is a sectional view of the extraction device 20 inserted into the discharge tube 12. As illustrated in FIG. 4, the bar 21 is a columnar shaped bar that extends straight along the X-axis. However, the bar 21 is not limited thereto, and the bar 21 may also be bent, or may have a thick portion and a narrow portion. The bar 21, for example, is made of metal, but may also be made of other materials.

The flange unit 22 is provided at one end of the bar 21. The flange unit 22 is a disk-shaped portion, and is integrally formed with the bar 21. In other words, the bar 21 and the flange unit 22 are joined with each other. The flange unit 22 may also be a separate part from the bar 21.

The elastic body 23, for example, is made of urethane rubber having a rubber hardness of about 30 degrees, and is formed in a cylindrical shape. However, the shape of the elastic body 23 is not limited thereto, and for example, the elastic body 23 may also have a quadrangular tubular shape or a polygonal tubular shape. The elastic body 23 may be any member as long as it expands elastically in one direction when the elastic body 23 is compressed from the other direction, and for example, may also be made of other types of rubber such as synthetic rubber and silicon rubber, a coil spring covered by a protection material (sliding material and coating material) such as synthetic resin, or other components such as a balloon.

In the present specification, a tubular shape has an opening (hollow) extending from one end to the other end. The opening is not limited to a straight extending hole, and may also be bent, or may have a narrow portion and a thick portion. The exterior and the opening may also have different shapes from each other.

The elastic body 23 extends straight along the X-axis. However, the elastic body 23 is not limited thereto, and may also be bent, or may have a thick portion and a narrow portion.

The elastic body 23 includes a first end 31, a second end 32, and a first opening 33. The second end 32 is positioned opposite from the first end 31, and faces a receiving face 22*a* of the flange unit 22. The receiving face 22*a* of the flange unit 22 is an example of a first portion. The first opening 33 extends along the X-axis, and opens to the first end 31 and the second end 32. In other words, the first opening 33 extends from the first end 31 to the second end 32.

The bar 21 is disposed through the first opening 33. A gap is formed between an inner peripheral face 23*a* of the elastic body 23 that forms the first opening 33 and an outer peripheral face 21*a* of the bar 21. The inner peripheral face 23*a* of the elastic body 23 may be brought into close contact with the outer peripheral face 21*a* of the bar 21. The elastic body 23 is movable along the bar 21.

The tube body 24, for example, is made of metal, and is formed in a cylinder shape. The tube body 24 is harder than the elastic body 23. The tube body 24 extends straight along the X-axis. However, the tube body 24 is not limited thereto, and may also be bent, or may have a thick portion and a narrow portion.

The tube body 24 includes one end 34, another end 35, and a second opening 36. The one end 34 is an example of a second portion and faces the first end 31 of the elastic body 23. In other words, the elastic body 23 is interposed between the receiving face 22*a* of the flange unit 22 and the one end 34 of the tube body 24.

The second opening 36 extends along the X-axis and opens to the one end 34 and the other end 35, respectively. In other words, the second opening 36 extends from the one end 34 to the other end 35.

The bar 21 is disposed through the second opening 36. A gap is formed between an inner peripheral face 24*a* of the tube body 24 that forms the second opening 36, and the outer peripheral face 21*a* of the bar 21. The tube body 24 is movable along the bar 21.

The bar 21 is longer than the total length of the elastic body 23 and the tube body 24. Thus, the bar 21 projects from the other end 35 of the tube body 24. For example, the bar 21 projects from the other end 35 of the tube body 24, as much as the operator can grip it.

When the tube body 24 is moved toward the flange unit 22, the one end 34 of the tube body 24 comes into contact with the first end 31 of the elastic body 23. When the elastic body 23 is separated from the flange unit 22, the second end 32 of the elastic body 23 pressed by the tube body 24, comes into contact with the flange unit 22. In this manner, the tube body 24 can press the first end 31 of the elastic body 23 toward the flange unit 22.

Hereinafter, an example of the size of the extraction device 20 and the discharge tube 12 will be described with reference to FIG. 4. It is noted that the size of the extraction device 20 and the discharge tube 12 is not limited to those described below. The inner diameter $di_{tube}$ of the opening 19 of the discharge tube 12, which is extracted from the ozone generation device 10 by the extraction device 20, for example, is 41 [mm].

The outer diameter d1 of the elastic body 23, for example, is 40 [mm]. The outer diameter d1 of the elastic body 23, for example, is from 0.95 to 0.99 times of the inner diameter $di_{tube}$ of the opening 19 of the discharge tube 12. However, the outer diameter d1 of the elastic body 23 is not limited thereto.

The length L1 of the elastic body 23 along the X-axis, for example, is 50 [mm]. The length L1 of the elastic body 23, for example, is from 1.00 to 1.40 times of the inner diameter $di_{tube}$ of the opening 19 of the discharge tube 12. However, the length L1 of the elastic body 23 is not limited thereto.

The outer diameter d2 of the flange unit 22, for example, is 35 [mm]. The outer diameter d2 of the flange unit 22, for example, is from 0.70 to 1.00 times of the outer diameter d1 of the elastic body 23. However, the outer diameter d2 of the flange unit 22 is not limited thereto.

The outer diameter d3 of the tube body 24, for example, is 35 [mm]. The outer diameter d3 of the tube unit 24, for example, is from 0.70 to 1.00 times of the outer diameter d1 of the elastic body 23. However, the outer diameter d3 of the tube body 24 is not limited thereto. Also, the outer diameter d2 of the flange unit 22 may be different from the outer diameter d3 of the tube body 24.

The outer diameter d4 of the bar 21, for example, is from 0.95 to 1.00 times of the inner diameter d5 of the first opening 33 of the elastic body 23. The elastic body 23 is movable relative to the bar 21 in the axis direction. It is noted that the outer diameter d4 of the bar 21 and the inner diameter d5 of the first opening 33 of the elastic body 23 are not limited thereto. The outer diameter d4 of the bar 21 is smaller than the outer diameter d2 of the flange unit 22.

When the elastic body 23 and the discharge tube 12 are positioned on the same axis, a gap between an outer peripheral face 23*b* of the elastic body 23 and an inner peripheral face 12*a* of the discharge tube 12 that forms the opening 19, for example, is 0.5 [mm]. The gap is a distance between the outer peripheral face 23*b* of the elastic body 23 and the inner peripheral face 12*a* of the discharge tube 12. The outer peripheral face 23*b* of the elastic body 23 is an example of a contact face, and faces in a radial direction of the elastic body 23. The radial direction is the direction on the Y-Z plane, and an example of a second direction.

When the elastic body 23 and the bar 21 are positioned on the same axis, a gap between the inner peripheral face 23*a* of the elastic body 23 that forms the first opening 33 and the outer peripheral face 21*a* of the bar 21, for example, is 0.1 [mm]. The gap is a distance between the inner peripheral face 23*a* of the elastic body 23 and the outer peripheral face 21*a* of the bar 21. As stated above, the gap between the outer peripheral face 23*b* of the elastic body 23 and the inner peripheral face 12*a* of the discharge tube 12 is wider than the gap between the inner peripheral face 23*a* of the elastic body 23 and the outer peripheral face 21*a* of the bar 21.

Hereinafter, an example of a method for extracting the discharge tube 12 from the ozone generation device 10 using the extraction device 20 will be described. The method for extracting the discharge tube 12 from the ozone generation device 10 using the extraction device 20 is not limited to the following description.

The discharge tube 12 is extracted in an extraction direction D1 illustrated in an arrow in FIG. 4. The extraction direction D1 is an example of a first direction, and the direction toward which the opening end of the discharge tube 12, which is a tube having a bottom, faces. The extraction direction D1 is the direction along the X-axis.

The extraction device 20 is inserted into the opening end of the discharge tube 12, in the opposite direction from the extraction direction D1. A part of the bar 21, the flange unit 22, the elastic body 23, and a part of the tube body 24 of the extraction device 20 are inserted into the discharge tube 12.

When the extraction device 20 is inserted into the discharge tube 12, a part of the bar 21 and a part of the tube body 24 are positioned outside the discharge tube 12. The tube body 24 may be positioned completely outside the discharge tube 12. The first end 31 of the elastic body 23 faces the extraction direction D1, and the bar 21 extends toward the extraction direction D1.

Figure 5:
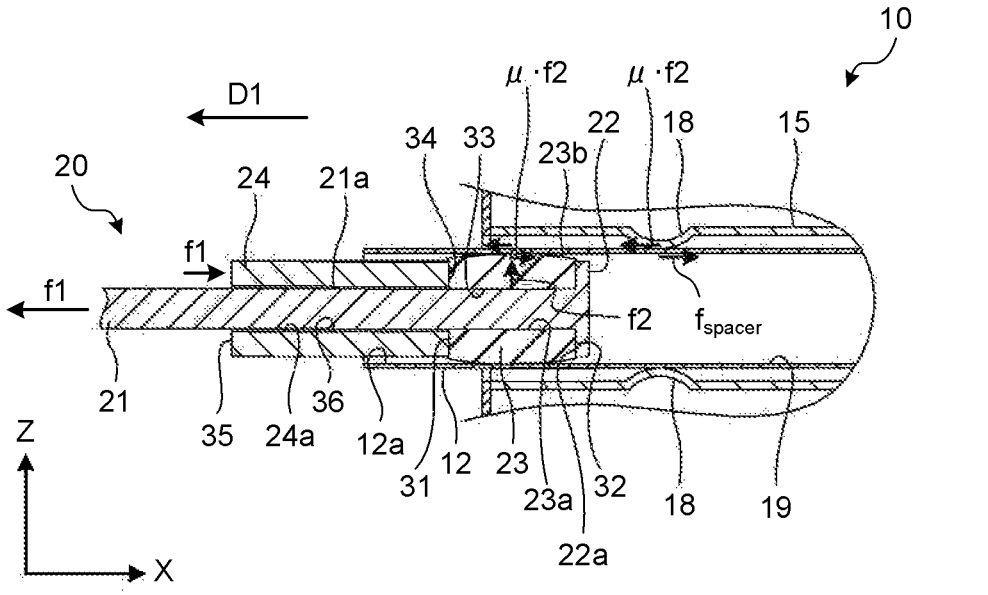
FIG. 5 is a sectional view of the extraction device of the first embodiment in which an elastic body is compressed.

FIG. 5 is a sectional view of the extraction device 20 in which the elastic body 23 is compressed. As illustrated in FIG. 5, the tube body 24 is pressed toward the flange unit 22 with the force f1 [N]. At the same time, the bar 21 is pulled in the extraction direction D1 with the force f1 [N]. Thus, the first end 31 of the elastic body 23 is pressed by the one end 34 of the tube body 24, and the second end 32 of the elastic body 23 is pressed by the flange unit 22 joined to the bar 21.

The elastic body 23 is interposed between the flange unit 22 and the tube body 24, to which the force f1 [N] is applied respectively, and is compressed. In other words, the elastic body 23 is compressed with the pressing force of the tube body 24 and the pressing force of the flange unit 22.

The compressed elastic body 23 expands (inflates) in the radial direction orthogonal to the extraction direction D1. Thus, the inner peripheral face 23*a* of the elastic body 23 comes into contact with the outer peripheral face 21*a* of the bar 21, and the outer peripheral face 23*b* of the elastic body 23 comes into contact with the inner peripheral face 12*a* of the discharge tube 12. In other words, when the receiving face 22*a* of the flange unit 22 and the one end 34 of the tube body 24 approach each other, the elastic body 23 expands elastically in a direction intersecting with the direction toward which the receiving face 22*a* of the flange unit 22 and the one end 34 of the tube body 24 approach each other.

The outer peripheral face 23*b* of the elastic body 23, which is compressed and expanded, presses the inner peripheral face 12*a* of the discharge tube 12 with the force f2 [N]. The elastic body 23 retains the discharge tube 12 while being expanded in the radial direction. The size of the force f2 is determined, for example, by the size of the force f1, the size of the elastic body 23, the size of the discharge tube 12, and the mechanical material constants of the elastic body 23.

The bar 21 is further pulled in the extraction direction D1, while the outer peripheral face 23*b* of the elastic body 23 is in contact with the inner peripheral face 12*a* of the discharge tube 12. Thus, the friction force $\mu \cdot f2$ [N] is generated between the outer peripheral face 23*b* of the elastic body 23 and the inner peripheral face 12*a* of the discharge tube 12. $\mu$ is a coefficient of friction. The force toward the extraction direction D1, the size of which is the same as that of the friction force $\mu \cdot f2$, is applied to the discharge tube 12. In other words, the discharge tube 12 is pulled by the friction that generates the force $\mu \cdot f2$ [N].

When the bar 21 is pulled, the friction force $f_{spacer}$ [N] that restricts the discharge tube 12 from moving, is generated between the discharge tube 12 and the spacer 18. The force $\mu \cdot f2$ that pulls the discharge tube 12 is smaller than the maximum value of the friction force $f_{spacer}$ that restricts the discharge tube 12 from moving. Thus, the discharge tube 12 does not move and maintains a static state.

Figure 6:
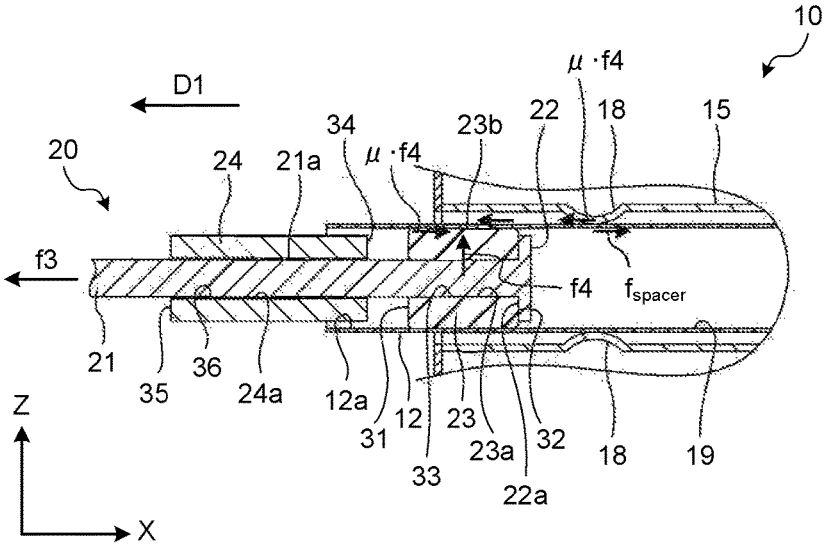
FIG. 6 is a sectional view of the extraction device of the first embodiment in which the force applied to a tube is released.

FIG. 6 is a sectional view of the extraction device 20 when the bar 21 is extracted and the force applied to the tube body 24 is released. As illustrated in FIG. 6, the bar 21 is pulled in the extraction direction D1 with the force f3 [N]. The force f3 is larger than the force f1.

At the same time, the force f1 that presses the tube body 24 is released. For example, an operator who has been pressing the tube body 24 releases his hand from the tube body 24. For example, the tube body 24 is separated from the elastic body 23. Thus, the tube body 24 does not apply the pressing force to the elastic body 23 nor support the elastic body 23. The tube body 24 may also remain in contact with the elastic body 23.

The bar 21 is pulled with the force f3, while the outer peripheral face 23*b* of the elastic body 23 is in contact with the inner peripheral face 12*a* of the discharge tube 12. Thus, although the force f1 is released from the tube body 24, the friction force μ·f4 [N] is generated between the outer peripheral face 23*b* of the elastic body 23 and the inner peripheral face 12*a* of the discharge tube 12. The elastic body 23 is compressed and expands further in the radial direction, with the friction force μ·f4 and the force f3 that pulls the bar 21 and the flange unit 22. The expanding elastic body 23 presses the inner peripheral face 12*a* of the discharge tube 12 with the force f4 [N].

The friction force μ·f4 and the force f3 that pulls the bar 21 are equal. Further, the force toward the extraction direction D1, the size of which is the same as that of the friction force μ·f4, is applied to the discharge tube 12. However, the force μ·f4 is smaller than the maximum value of the friction force $f_{spacer}$ between the discharge tube 12 and the spacer 18. Thus, the discharge tube 12 does not move and maintains a static state.

Figure 7:
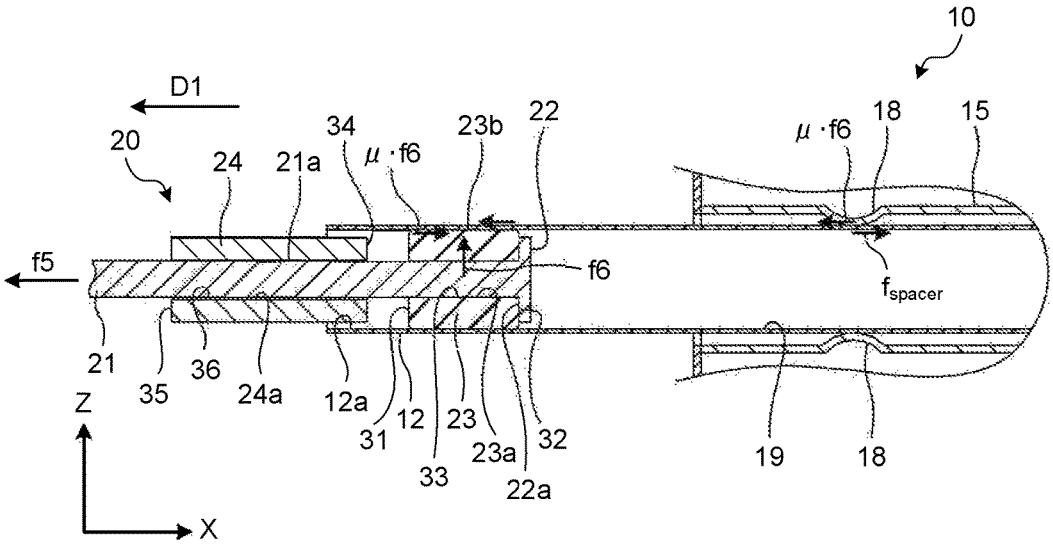
FIG. 7 is a sectional view of the extraction device of the first embodiment that extracts the discharge tube.

FIG. 7 is a sectional view of the extraction device 20 that extracts the discharge tube 12 from the ozone generation device 10. As illustrated in FIG. 7, the bar 21 is pulled in the extraction direction D1 with the force f5 [N]. The force f5 is larger than the force f3.

When the bar 21 is pulled with the force f5, the elastic body 23 is further compressed, and further expands in the radial direction. Thus, the elastic body 23 presses the inner peripheral face 12*a* of the discharge tube 12 with the force f6, which is larger than the force f4.

When the elastic body 23 presses the inner peripheral face 12*a* of the discharge tube 12 with the force f6, the friction force μ·f6 [N] is generated between the outer peripheral face 23*b* of the elastic body 23 and the inner peripheral face 12*a* of the discharge tube 12. The force toward the extraction direction D1, the size of which is the same as that of the friction force μ·f6, is applied to the discharge tube 12. In other words, the discharge tube 12 is pulled by the force μ·f6 [N]. The force μ·f6 and the force f5 that pulls the bar 21 are equal.

The force μ·f6 is larger than the maximum value of the friction force $f_{spacer}$ between the discharge tube 12 and the spacer 18. Thus, the discharge tube 12 moves in the extraction direction D1. In other words, the discharge tube 12 is extracted from the tube unit 15 of the ozone generation device 10.

Figure 8:
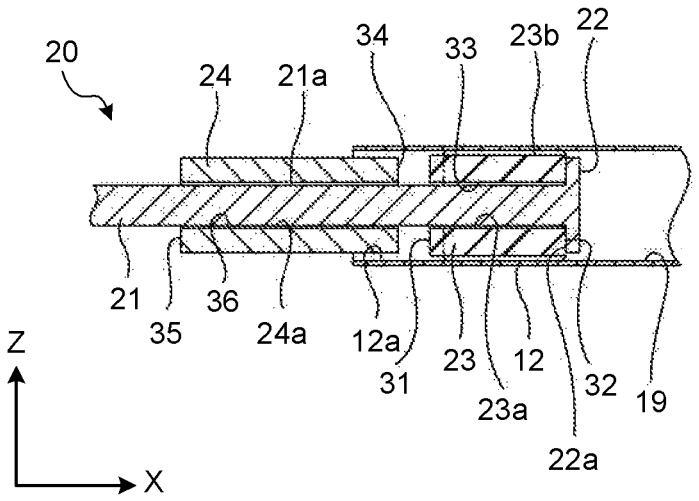
FIG. 8 is a sectional view of the extraction device of the first embodiment in which the force applied to a bar is released.

FIG. 8 is a sectional view of the extraction device 20 in which the force applied to the bar 21 is released. As illustrated in FIG. 8, when the discharge tube 12 is extracted from the ozone generation device 10, the force f5 that pulls the bar 21 is released. For example, the operator who has been pulling the bar 21 releases his hand from the bar 21.

When the force f5 that pulls the bar 21 is released, the force f5 applied to the elastic body 23 from the flange unit 22 is also released. In other words, the force that compresses the elastic body 23 is lost. Thus, the elastic body 23 returns to the original shape illustrated by a solid line, from the compressed state illustrated by a two-dot chain line indicated in FIG. 8. The inner peripheral face 23*a* of the elastic body 23 is separated from the outer peripheral face 21*a* of the bar 21, and the outer peripheral face 23*b* of the elastic body 23 is separated from the inner peripheral face 12*a* of the discharge tube 12. When the bar 21 is pulled in the extraction direction D1 at this state, the extraction device 20 is extracted from the discharge tube 12.

The force f1 to the force f6 and the force $f_{spacer}$ spacer described above are almost uniformly applied in the circumference direction, respectively. The force f1 to the force f6 and the force $f_{spacer}$ are the total of the pressure almost uniformly distributed to the portion to which the force is applied. The pressure on the portion to which the force f1 to the force f6 and the force $f_{spacer}$ are applied, may vary.

In the first embodiment, the elastic body 23 is compressed when the tube body 24 is pressed toward the flange unit 22. The compressed elastic body 23 is expanded, and comes into contact with the discharge tube 12. When the bar 21 is pulled in the extraction direction D1 at this state, the friction force is generated between the discharge tube 12 and the elastic body 23. Thus, even if the tube body 24 does not press the elastic body 23 subsequently, the elastic body 23 is compressed and expanded by the friction force and the force that presses the elastic body 23 together with the flange unit 22, which is pulled by the bar 21. Hence, the friction force continues to generate between the discharge tube 12 and the elastic body 23. In other words, the elastic body 23 is compressed with the pressing force due to the friction generated at the inner peripheral face 12*a* of the discharge tube 12, and the pressing force of the flange unit 22. Consequently, the state in which the elastic body 23 is expanded is maintained. Consequently, there is no need to press the tube body 24 continuously toward the flange unit 22, and the discharge tube 12 can be extracted from the ozone generation device 10 with the friction force, by only pulling the bar 21.

The force that presses the discharge tube 12 with the expanding elastic body 23 and the friction force applied to the discharge tube 12 are almost uniform in the circumference direction of the discharge tube 12. Thus, it is possible to prevent the large force from being locally applied to the discharge tube 12. Consequently, it is possible to prevent the discharge tube 12 made of glass from being damaged.

As stated above, according to the extraction device 20, a state in which the extraction device 20 retains the discharge tube 12 can be obtained more easily, by compressing the elastic body 23 in the axis direction by the flange unit 22 and the tube body 24, and expanding the elastic body 23 in the radial direction. Hence, it is possible to extract the discharge tube 12 more easily. Also, there is no need to press the tube body 24 continuously toward the flange unit 22, during the extraction operation of the discharge tube 12. There is also no need to pay attention to prevent the large force from being locally applied to the discharge tube 12. As a result, it is possible to extract the discharge tube 12 more easily.

The extraction device 20 is used while being inserted into the discharge tube 12. Thus, the extraction device 20 is prevented from coming into contact with, for example, the other discharge tubes 12 adjacent to the discharge tube 12 to be extracted. Hence, it is possible to extract the closely adjacent discharge tubes 12 more easily.

The bar 21 is disposed through the second opening 36, and the tube body 24 is movable along the bar 21. Thus, the tube body 24 can easily press the elastic body 23 with uniform force in the circumference direction. Consequently, it is possible to reduce the expansion variation of the elastic body 23 in the radial direction. It is also possible to prevent a large force from being locally applied to the discharge tube 12.

The elastic body 23 is made of urethane rubber, which is an example of rubber having a hardness of about 30 degrees. Because such a soft elastic body 23 comes into contact with the discharge tube 12, it is possible to prevent the discharge tube 12 from being damaged.

Figure 9:
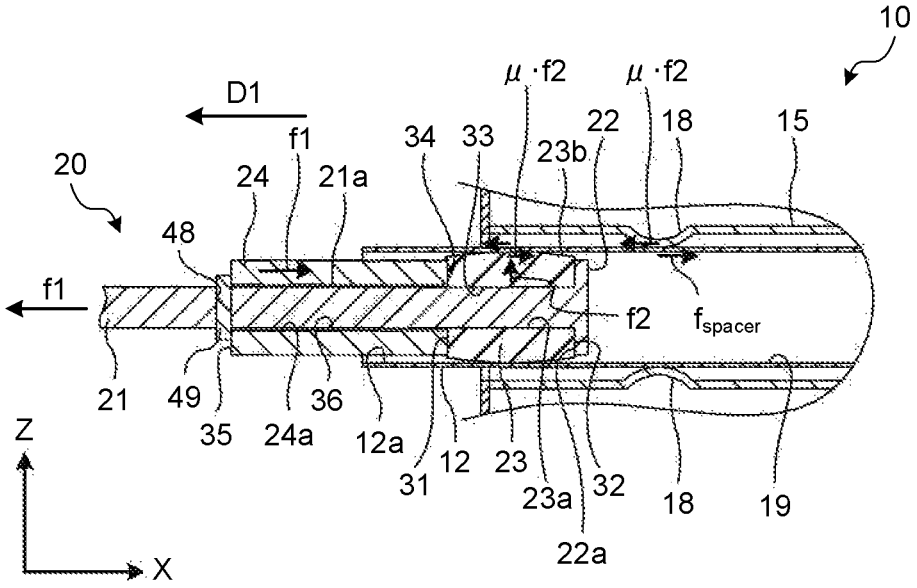
FIG. 9 is a sectional view of a modification of the extraction device of the first embodiment.

FIG. 9 is a sectional view of a modification of the extraction device 20 of the first embodiment. As illustrated in FIG. 9, the bar 21 includes a pin hole 48, and a pin 49 may be removably fitted into the pin hole 48. The pin 49 is an example of a retaining unit.

The pin 49 is inserted into the pin hole 48 when the elastic body 23 is compressed by the tube body 24 and the flange unit 22. The pin 49 fitted into the pin hole 48 retains the tube body 24 at the position where the elastic body 23 is compressed by the tube body 24 and the flange unit 22. In other words, the pin 49 restricts the tube body 24 from moving, by the restoring force of the elastic body 23, by coming into contact with the other end 35 of the tube body 24. More specifically, the pin 49 prevents the elastic body 23 from pushing back the tube body 24 by its restoring force, and prevents the pressing force applied to the elastic body 23 by the tube body 24 from being released.

As described above, the pin 49 retains the tube body 24 while the tube body 24 compresses the elastic body 23 together with the flange unit 22. In other words, the pin 49 locks the tube body 24 and the flange unit 22, while the elastic body 23 is in an expanded state. Thus, for example, even if the operator releases his hand from the tube body 24, the tube body 24 continuously presses the elastic body 23 with the force f1.

In the extraction operation of the first embodiment, the force that presses the elastic body 23 by the tube body 24 is released during the operation. However, as the modification illustrated in FIG. 9, the tube body 24 may be fixed to the bar 21 with the pin 49, in a state in which the elastic body 23 is compressed by the tube body 24 and the flange unit 22. Because the elastic body 23 continues to be compressed by the tube body 24 and the flange unit 22, the discharge tube 12 is extracted further more easily.

The pin 49 retains the tube body 24 by being inserted into the pin hole 48 provided at a predetermined position. Thus, the pressure force applied to the elastic body 23 from the tube body 24, and the pressure force applied to the inner peripheral face 12*a* of the discharge tube 12 from the elastic body 23, can be easily set to a desirable size.

The retaining unit is not limited to the pin 49. The retaining unit, for example, may also be another member such as a key, or a portion such as a depression and a projection integrally formed with another member. For example, a protrusion may be provided on the inner peripheral face 24*a* of the tube body 24, and a groove that engages with the protrusion may be provided on the outer peripheral face 21*a* of the bar 21. The protrusion and the groove may be an example of the retaining unit. The retaining unit may also be a nut using screw pairs.

Hereinafter, a second embodiment will be described with reference to FIG. 10. In a plurality of embodiments described below, the components that have the same functions as the components described above are denoted with the same reference numerals as the above-described components, and the descriptions thereof may be omitted. All the functions and properties of the components denoted with the same reference numerals are not necessarily common, and the components may have different functions and properties according to each embodiment.

Figure 10:
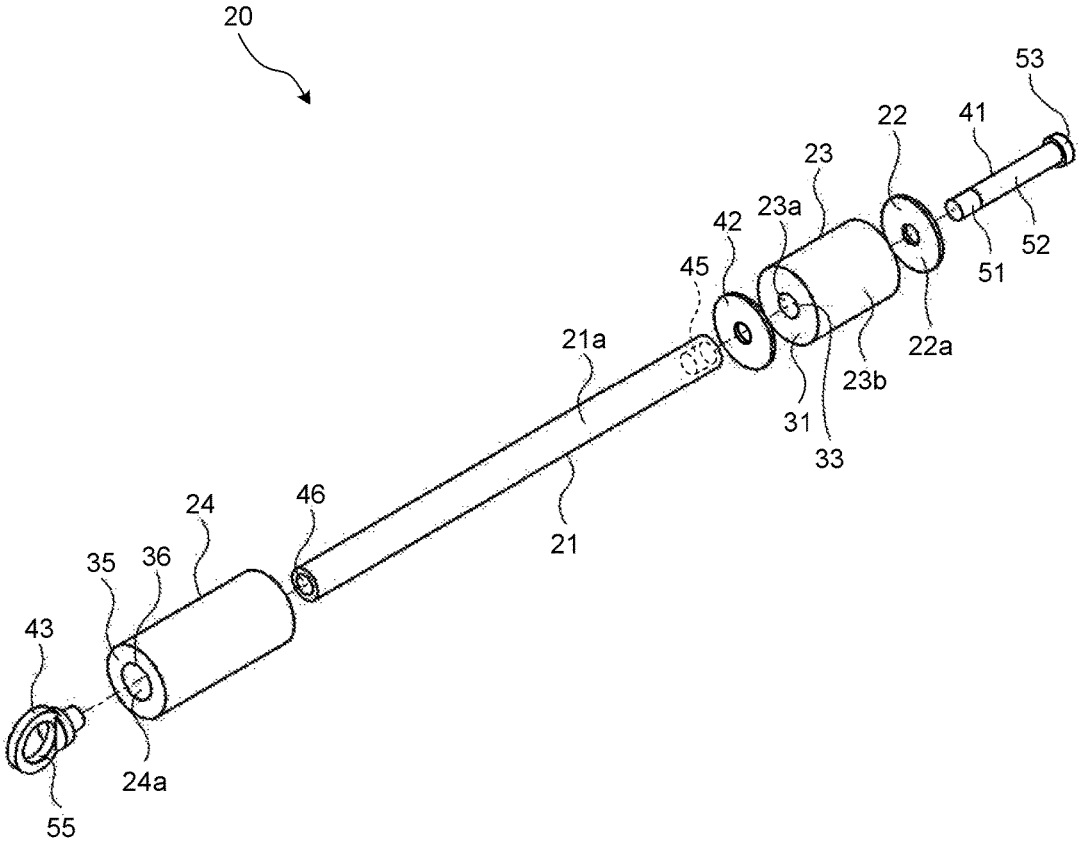
FIG. 10 is an exploded perspective view of an extraction device according to a second embodiment.

FIG. 10 is an exploded perspective view of the extraction device 20 according to the second embodiment. As illustrated in FIG. 10, the extraction device 20 includes the bar 21, the flange unit 22, the elastic body 23, the tube body 24, a bolt 41, a washer 42, and an eyebolt 43. In the second embodiment, the bar 21 and the bolt 41 are an example of the pulling unit. The washer 42 is an example of an intermediate member. The eyebolt 43 is an example of a hooking unit.

In the second embodiment, the bar 21 and the flange unit 22 are separate members. A first screw hole 45 is provided at one end of the bar 21. A second screw hole 46 is provided at the other end of the bar 21. The bar 21 is disposed through the tube body 24.

The bolt 41 includes a screw portion 51, a shaft portion 52, and a head portion 53. The screw portion 51 is a portion where a male screw is threaded, and screwed into the first screw hole 45 of the bar 21. The shaft portion 52 is a bar-like portion that continues from the screw portion 51. The head portion 53 is provided at the end of the shaft portion 52. The outer diameter of the head portion 53 is larger than the outer diameter of the shaft portion 52.

The shaft portion 52 of the bolt 41 is disposed through the flange unit 22, the elastic body 23, and the washer 42. In the second embodiment, the flange unit 22 is formed in a disk-like shape provided with an opening in the center. The shaft portion 52 of the bolt 41 is disposed through the opening of the flange unit 22. The head portion 53 of the bolt 41 supports the flange unit 22.

The washer 42 is formed in a disk-like shape provided with an opening in the center. The washer 42 faces the first end 31 of the elastic body 23. The washer 42 is interposed between the first end 31 of the elastic body 23 and the tube body 24. The washer 42 is movable toward the flange unit 22 along the shaft portion 52. Thus, the tube body 24 can press the first end 31 of the elastic body 23 toward the flange unit 22 through the washer 42.

The outer diameter of the washer 42 is about the same as the outer diameter d1 of the elastic body 23. The inner diameter of the washer 42 is about the same as the inner diameter d5 of the first opening 33 of the elastic body 23. The contact area between the washer 42 and the elastic body 23 is larger than the contact area between the tube body 24 and the washer 42.

The eyebolt 43 is screwed into the second screw hole 46 of the bar 21. The eyebolt 43 is provided with a hole 55. The hole 55 is opened in a direction intersecting with the X-axis and the extraction direction D1.

The extraction device 20 of the second embodiment can extract the discharge tube 12 from the ozone generation device 10, using the same method of the extraction device 20 of the first embodiment. Further, because the bar 21, the flange unit 22, and the bolt 41 are separate members, it is possible to reduce the processing cost of the bar 21.

The washer 42 is arranged between the elastic body 23 and the tube body 24. The contact area between the washer 42 and the elastic body 23 is larger than the contact area between the tube body 24 and the washer 42. Thus, the tube body 24 can press the elastic body 23 with more uniform force in the circumference direction.

Consequently, the elastic body 23 can be uniformly expanded in the radial direction. It is also possible to easily prevent the large force from being locally applied to the discharge tube 12. The intermediate member is not limited to the washer 42.

For example, a rope is attached to the hole 55 of the eyebolt 43 disposed at the end of the bar 21. When the rope is pulled by a winch, the discharge tube 12 can be easily extracted. The hooking unit is not limited to the eyebolt 43, and for example, may be a hook.

Figure 11:
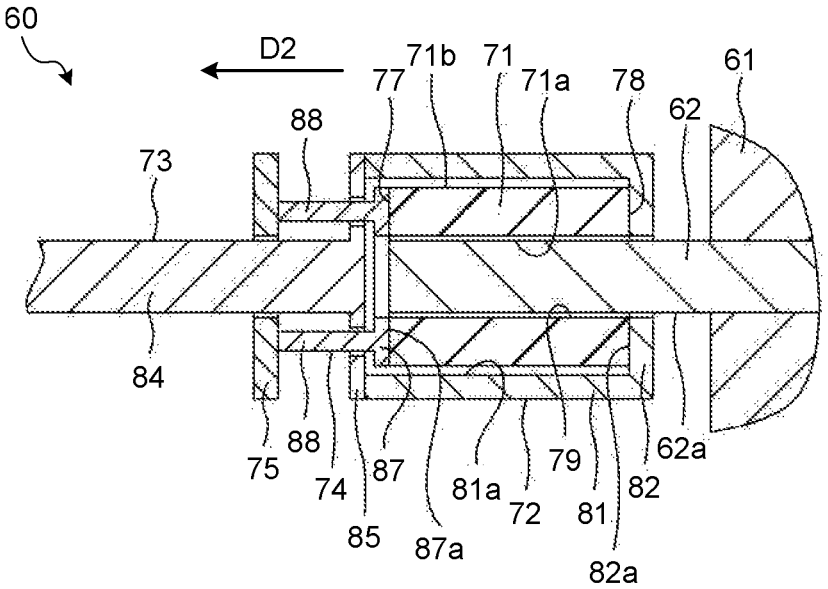
FIG. 11 is a sectional view of an extraction device according to a third embodiment.

Hereinafter, a third embodiment will be described with reference to FIG. 11 to FIG. 13. FIG. 11 is a sectional view of an extraction device 60 according to the third embodiment. The extraction device 60, for example, is a device that extracts a peg 62 driven into a wall 61. The peg 62 is an example of an object to be extracted.

As illustrated in FIG. 11, the extraction device 60 includes an elastic body 71, a cover 72, a pulling unit 73, a pressing unit 74, and a pressing ring 75. The elastic body 71 is an example of the third member. The cover 72 is an example of the first member. The pressing unit 74 is an example of the second member.

The elastic body 71 is the same as the elastic body 23 in the first embodiment. In other words, the elastic body 71, for example, is made of urethane rubber having a rubber hardness of about 30 degrees, and is formed in a cylindrical shape. The elastic body 71 may also be different from the elastic body 23 in the first embodiment.

The elastic body 71 includes a first end 77, a second end 78, and a first opening 79. The second end 78 is positioned opposite from the first end 77. The first opening 79 is opened to the first end 77 and the second end 78. The peg 62 can be disposed through the first opening 79. In other words, the inner diameter of the first opening 79 is larger than the outer diameter of the peg 62.

The cover 72 includes a cylinder portion 81 and a bottom 82. The bottom 82 is an example of the second pressing unit. The cylinder portion 81 is integrally formed with the bottom 82. The cylinder portion 81 and the bottom 82 may also be different members.

The cylinder portion 81 encloses around the elastic body 71 with a gap interposed therebetween. One end of the cylinder portion 81 is opened. The bottom 82 closes the other end of the cylinder portion 81. The bottom 82 includes a receiving face 82*a* facing the second end 78 of the elastic body 71. The receiving face 82*a* is an example of the first portion. An opening connected to the first opening 79 is provided at the bottom 82. The diameter of the opening is about the same as the inner diameter of the first opening 79. The peg 62 can be disposed through the opening of the bottom 82, and inserted into the first opening 79 of the elastic body 71.

The pulling unit 73 includes a rod-like portion 84 and a flange 85. The rod-like portion 84 is integrally formed with the flange 85. The rod-like portion 84 and the flange 85 may be different parts.

The rod-like portion 84 is formed in a columnar shape that extends on the same axis as the elastic body 71. The rod-like portion 84 extends toward an extraction direction D2 illustrated in an arrow in FIG. 11. The extraction direction D2 is an example of the first direction, and is the direction toward which the extraction device 60 pulls the peg 62. The flange 85 is formed at the end of the rod-like portion 84. The flange 85, for example, is fixed to the opening end of the cylinder portion 81 of the cover 72, by being welded thereto. Thus, the pulling unit 73 is joined to the cover 72. The flange 85 faces the first end 77 of the elastic body 71 facing the extraction direction D2.

The pressing unit 74 includes an abutting portion 87 and a plurality of insertion portions 88. The abutting portion 87 is an example of the first pressing unit, and integrally formed with the insertion portions 88. The abutting portion 87 and the insertion portions 88 may be separate parts. The pressing unit 74 is harder than the elastic body 71.

The abutting portion 87 is formed in a disk-like shape provided with an opening in the center. The abutting portion 87 is interposed between the first end 77 of the elastic body 71 and the flange 85. The abutting portion 87 includes a pressing face 87*a* that faces the first end 77 of the elastic body 71. The pressing face 87*a* is an example of the second portion. Thus, the elastic body 71 is interposed between the receiving face 82*a* of the bottom 82 and the pressing face 87*a* of the abutting portion 87.

Each of the insertion portions 88 extends toward the extraction direction D2 from the abutting portion 87. The insertion portion 88 passes through the hole provided on the flange 85, and projects from the flange 85 in the extraction direction D2.

The pressing ring 75 is formed in a disk-like shape provided with an opening in the center. The rod-like portion 84 of the pulling unit 73 is disposed through the opening of the pressing ring 75. The pressing ring 75 is movable along the rod-like portion 84.

The pressing ring 75 comes into contact with the insertion portions 88 projecting from the flange 85. When the pressing ring 75 is pressed toward the bottom 82 of the cover 72, the abutting portion 87 of the pressing unit 74 presses the first end 77 of the elastic body 71 toward the bottom 82. Because the pressing ring 75 comes into contact with the insertion portions 88, the abutting portion 87 can uniformly and easily press the elastic body 71 in the circumference direction.

Hereinafter, an example of a method for extracting the peg 62 from the wall 61, using the extraction device 60 of the third embodiment will be described. The method for extracting the peg 62 from the wall 61 using the extraction device 60 is not limited to the following description.

First, the peg 62 is inserted into the first opening 79 of the elastic body 71 from the opening of the bottom 82. An inner peripheral face 71*a* of the elastic body 71 that forms the first opening 79 faces an outer peripheral face 62*a* of the peg 62 throughout the entire area. The inner peripheral face 71*a* of the elastic body 71 is an example of the contact face. Only a part of the inner peripheral face 71*a* of the elastic body 71 may face the outer peripheral face 62*a* of the peg 62.

Figure 12:
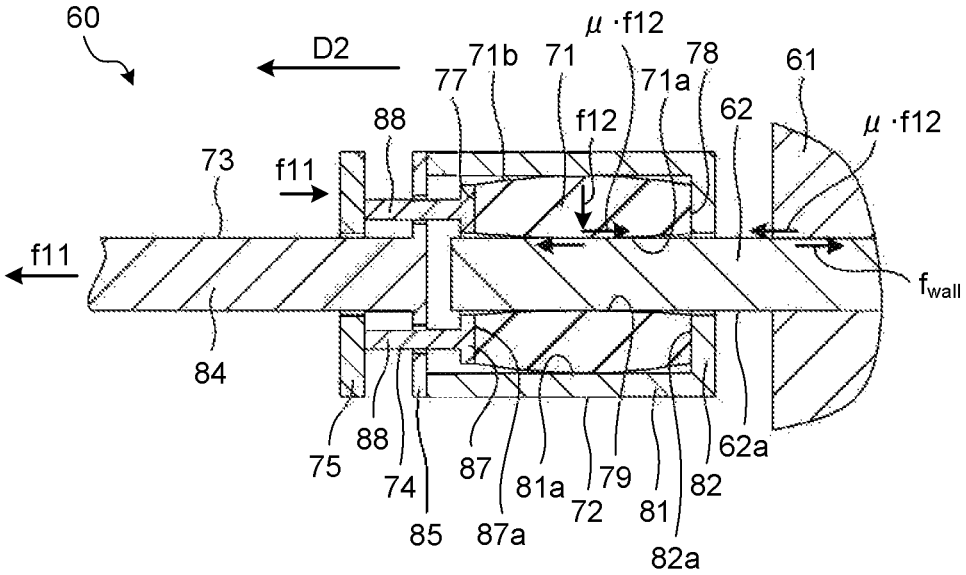
FIG. 12 is a sectional view of the extraction device of the third embodiment in which the elastic body is compressed.

FIG. 12 is a sectional view of the extraction device 60 in which the elastic body 71 is compressed. As illustrated in FIG. 12, the pressing ring 75 is pressed toward the bottom 82 with the force f11 [N]. At the same time, the rod-like portion 84 is pulled in the extraction direction D2 with the force f11 [N]. Thus, the abutting portion 87 of the pressing unit 74 presses the first end 77 of the elastic body 71, and the bottom 82 presses the second end 78 of the elastic body 71.

The elastic body 71 is interposed between the bottom 82 and the abutting portion 87, and is compressed. In other words, the elastic body 71 is compressed with the pressing force of the bottom 82 and the pressing force of the abutting portion 87. The compressed elastic body 71 is expanded in the radial direction orthogonal to the extraction direction D2. The radial direction is an example of the second direction.

When the elastic body 71 is expanded in the radial direction, the inner peripheral face 71*a* of the elastic body 71 comes into contact with the outer peripheral face 62*a* of the peg 62, and an outer peripheral face 71*b* of the elastic body 71 comes into contact with an inner peripheral face 81*a* of the cylinder portion 81. In other words, when the receiving face 82*a* of the bottom 82 and the pressing face 87*a* of the abutting portion 87 approach each other, the elastic body 71 elastically expands in the direction intersecting with the direction toward which the receiving face 82*a* of the bottom 82 and the pressing face 87*a* of the abutting portion 87 approach each other. The inner peripheral face 71*a* of the elastic body 71 being compressed and expanded, presses the outer peripheral face 62*a* of the peg 62 with the force f12 [N].

The rod-like portion 84 is pulled in the extraction direction D2, while the inner peripheral face 71*a* of the elastic body 71 is in contact with the outer peripheral face 62*a* of the peg 62. Thus, the friction force μ·f12 [N] is generated between the inner peripheral face 71*a* of the elastic body 71 and the outer peripheral face 62*a* of the peg 62. Further, the force toward the extraction direction D2, the size of which is the same as that of the friction force μ·f12, is applied to the peg 62. In other words, the peg 62 is pulled by the friction between the peg 62 and the inner peripheral face 71*a* of the elastic body 71.

When the rod-like portion 84 is pulled, the friction force of $f_{well}$ [N] that restricts the peg 62 from moving, is applied between the peg 62 and the wall 61. The force μ·f12 that pulls the peg 62 is smaller than the maximum value of the friction force of $f_{wall}$ that restricts the peg 62 from moving. Thus, the peg 62 does not move and maintains a static state.

Figure 13:
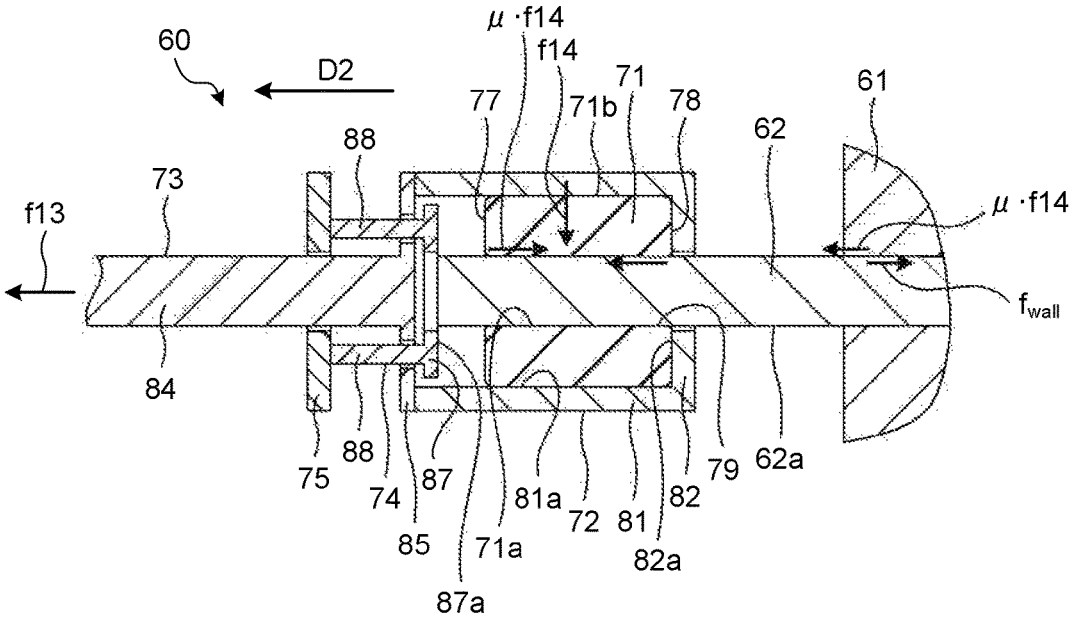
FIG. 13 is a sectional view of the extraction device of the third embodiment that extracts a peg.

FIG. 13 is a sectional view of the extraction device 60 that extracts the peg 62 from the wall 61. As illustrated in FIG. 13, the rod-like portion 84 is pulled in the extraction direction D2 with the force f13 [N]. The force f13 is larger than the force f11.

At the same time, the force f11 that presses the pressing ring 75 is released. The pressing ring 75 and the pressing unit 74 may be separated from the elastic body 71 or may remain in contact with the elastic body 71.

The rod-like portion 84 is pulled by the force f13, while the inner peripheral face 71*a* of the elastic body 71 is in contact with the outer peripheral face 62*a* of the peg 62. Thus, even if the force f11 is released from the pressing ring 75, the friction force μ·f14 [N] is generated between the inner peripheral face 71*a* of the elastic body 71 and the outer peripheral face 62*a* of the peg 62. The elastic body 71 is compressed and expanded in the radial direction, by the friction force μ·f14 and the force f13 that pulls the rod-like portion 84 and the bottom 82. The expanding elastic body 71 presses the outer peripheral face 62*a* of the peg 62 with the force f14 [N].

The friction force μ·f14 and the force f13 that pulls the rod-like portion 84 are equal. Further, the force toward the extraction direction D2, the size of which is the same as that of the friction force μ·f14, is applied to the peg 62. When the force μ·f14 is larger than the maximum value of the friction force $f_{wall}$ between the peg 62 and the wall 61, the peg 62 moves in the extraction direction D2. In other words, the peg 62 is extracted from the wall 61.

After the peg 62 is extracted from the wall 61, when the force f13 that pulls the rod-like portion 84 is released, the elastic body 71 returns to the original shape. The extraction device 60 is removed from the peg 62, when the rod-like portion 84 is pulled in the extraction direction D2 at this state.

According to the extraction device 60 of the third embodiment, it is possible to easily extract the peg 62, which is not in a tubular shape, from the wall 61. The force that presses the outer peripheral face 62*a* of the peg 62 with the inner peripheral face 71*a* of the elastic body 71 is almost uniformly applied in the circumferential direction. Thus, it is possible to prevent the peg 62 from being damaged. It is noted that the extraction device 60 of the third embodiment may also be used to extract a tubular-shaped object.

In the first to third embodiments described above, a portion that increases the friction force such as a barb, may also be provided on the outer peripheral face 23*b* or the inner peripheral face 71*a* of the elastic body 23 or 71. In other words, a plurality of protrusions the protrusion amount of which is increased toward the extraction direction D1 or D2, may also be provided on the outer peripheral face 23*b* or the inner peripheral face 71*a* of the elastic body 23 or 71.

According to at least one of the embodiments described above, when the outer peripheral face or the inner peripheral face of the elastic body comes into contact with the object to be extracted, friction force is generated between the outer peripheral face or the inner peripheral face of the elastic body that comes into contact with the object to be extracted, and the object to be extracted, when the pulling unit is pulled in the extraction direction. The elastic body is compressed by the friction force and the receiving unit, and can expand in the direction intersecting with the extraction direction. Thus, it is possible to easily extract the object to be extracted.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

For example, the object to be extracted, which is to be extracted by the extraction device, is not limited to the discharge tube 12 and the peg 62. The elastic body is not limited to have a tubular shape, but may be a solid cylinder, or may have another shape such as a shape provided with a cut-out into which a bar can be inserted.

The invention claimed is:

1. An extraction device capable of being used with an object to be extracted, comprising:

an elastic body that includes a first end facing a first direction, a second end positioned opposite from the first end, and a contact face facing a second direction intersecting with the first direction, the elastic body configured to expand in the second direction;

a first pressing unit configured to press the first end of the elastic body with direct contact between the first pressing unit and the elastic body;

a second pressing unit configured to press the second end of the elastic body; and a pulling unit configured to pull the second pressing unit toward the first direction, wherein the contact face is configured to come into contact with the object to be extracted when the elastic body, compressed by pressing force of the first pressing unit and pressing force of the second pressing unit, expands in the second direction, the pulling unit is configured to pull the object to be extracted with friction between the object to be extracted and the contact face when the pulling unit is pulled in the first direction while the contact face of the elastic body is in contact with the object to be extracted, and when the pulling unit is pulled in the first direction while the contact face of the elastic body is in contact with the object to be extracted, the pulling unit is configured to pull the object to be extracted with the friction between the object to be extracted and the contact face while the first pressing unit is spaced apart from the first end.

2. The extraction device according to claim 1, wherein the elastic body is provided with a first opening extended in the first direction, the contact face includes an outer peripheral face of the elastic body, the first pressing unit is provided with a second opening extended in the first direction, the pulling unit is disposed through the first opening and the second opening, and the contact face of the elastic body expanded in the second direction is configured to come into contact with an inner peripheral face of a third opening provided on the object to be extracted.

3. The extraction device according to claim 1, wherein a hooking unit is provided at an end of the pulling unit.

4. The extraction device according to claim 2, wherein an outer diameter of the elastic body is from 0.95 to 0.99 times of an inner diameter of the third opening of the object to be extracted.

5. The extraction device according to claim 2, wherein length of the first pressing unit along the first direction is from 1.00 to 1.40 times of an inner diameter of the third opening of the object to be extracted.

6. The extraction device according to claim 2, wherein an outer diameter of the second pressing unit is from 0.70 to 1.00 times of an outer diameter of the elastic body.

7. The extraction device according to claim 2, wherein an outer diameter of the first pressing unit is from 0.70 to 1.00 times of an outer diameter of the elastic body.

8. The extraction device according to claim 2, wherein an outer diameter of the pulling unit is from 0.95 to 1.00 times of an inner diameter of the first opening of the elastic body.

9. The extraction device according to claim 2, wherein a gap between the contact face of the elastic body and the inner peripheral face of the third opening of the object to be extracted is larger than a gap between an inner peripheral face of the first opening of the elastic body and an outer peripheral face of the pulling unit disposed through the elastic body.

10. The extraction device according to claim 2, wherein the elastic body is made of rubber.

11. The extraction device according to claim 1, wherein the contact face of the elastic body expanded in the second direction is configured to come into contact with an outer peripheral face of the object to be extracted.

12. The extraction device according to claim 1, further comprising a retaining unit configured to retain the first pressing unit while the elastic body is compressed by the first pressing unit and the second pressing unit.

* * * * *